United States Patent [19]

Childress, Jr. et al.

[11] 4,172,344

[45] Oct. 30, 1979

[54] MASONRY UNITS HAVING REMOVABLE FLANGES

[75] Inventors: Paul V. Childress, Jr.; Donald E. Hogston; William C. Mongole, all of Roanoke, Va.; William D. Green, Charlotte, N.C.

[73] Assignee: Lightweight Block Company, Inc., Roanoke, Va.

[21] Appl. No.: 889,321

[22] Filed: Mar. 23, 1978

[51] Int. Cl.[2] ..... E04C 1/04

[52] U.S. Cl. ..... 52/98; 52/314; 52/603; 52/604; 52/569

[58] Field of Search ..... 52/98–100, 52/351–354, 357, 372, 605, 606, 314, 561, 562, 567, 569, 432–442, 314, 603, 604

[56] References Cited

U.S. PATENT DOCUMENTS

| | | | |
|---|---|---|---|
| 721,188 | 2/1903 | Higgins | 52/351 |
| 751,346 | 2/1904 | Schall | 52/351 |
| 938,678 | 11/1909 | Macbeth | 52/351 |
| 1,255,573 | 2/1918 | Atterbury | 52/367 |
| 1,526,730 | 2/1925 | Zottoli | 52/351 |
| 1,571,645 | 2/1926 | Rocic | 52/351 |
| 1,571,815 | 2/1926 | Stout | 52/314 |
| 1,683,441 | 9/1928 | Bone | 52/98 |
| 1,727,362 | 10/1929 | Bone | 52/98 |
| 1,925,103 | 9/1933 | Leftus et al. | 52/314 |
| 2,008,775 | 7/1935 | Staman | 52/374 |
| 2,047,882 | 7/1936 | McPherson | 52/347 |
| 2,185,669 | 1/1940 | Isenhour | 52/100 |
| 2,199,112 | 4/1940 | O'Leary | 52/405 |
| 2,700,294 | 1/1955 | Banneyer | 52/351 |
| 3,824,755 | 7/1974 | Hartnell | 52/314 |

FOREIGN PATENT DOCUMENTS

| | | | |
|---|---|---|---|
| 985377 | 3/1951 | France | 52/314 |
| 1208133 | 9/1959 | France | 52/314 |

*Primary Examiner*—James L. Ridgill, Jr.
*Attorney, Agent, or Firm*—Dowell & Dowell

[57] ABSTRACT

A masonry block unit having spaced, selectively removable, vertical flanges on its inner face which are so spaced that they may be laid in the same direction and overlapped corresponding to the spacing in order that alternate flanges will provide a continuous row for attaching cladding and between such rows standard insulation may be placed, with the removal of the flanges which do not fall in the continuous lines.

1 Claim, 8 Drawing Figures

FIG. 1
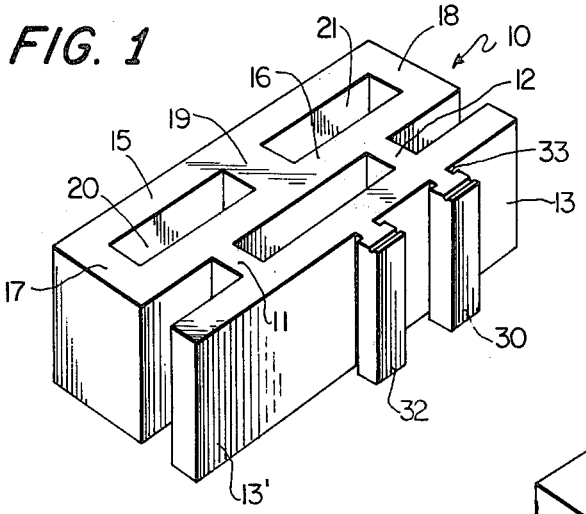
(PRIOR ART)
FIG. 2
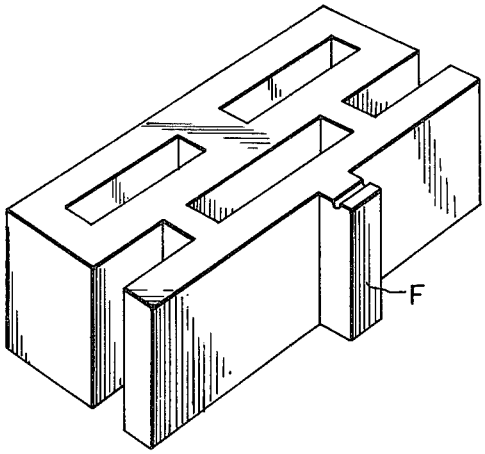
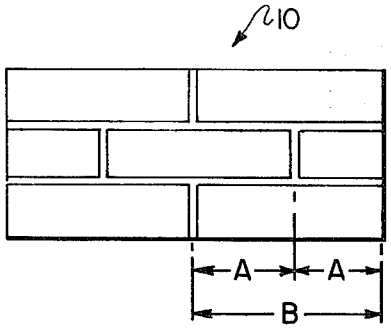
FIG. 3
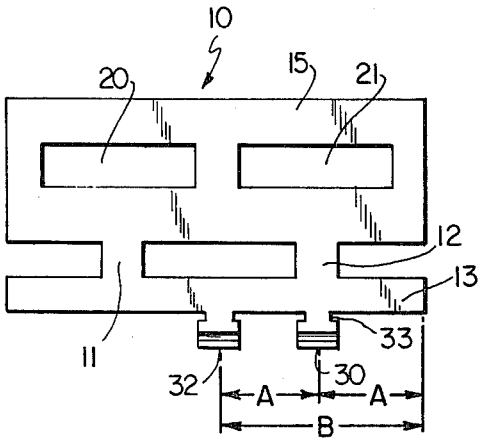
FIG. 4
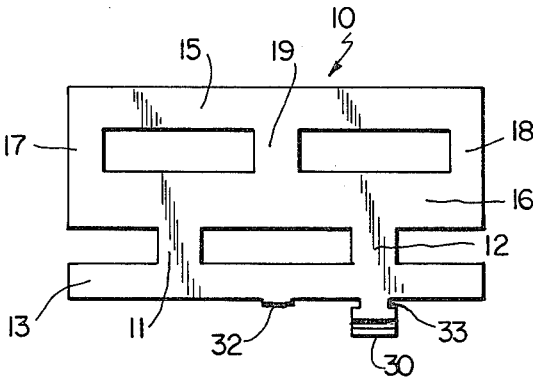
FIG. 5

MASONRY UNITS HAVING REMOVABLE FLANGES

BACKGROUND OF THE INVENTION

1. Field of the Invention

This invention relates to building materials and, more particularly, to preformed masonry units which are laid in courses to form walls for various kinds of structures.

The invention is particularly concerned with preformed masonry units which have integral flanges to which cladding may be attached and between which building elements such as insulation, wiring and pipes may be positioned. The invention also relates to masonry units having an outer face which is formed to simulate multiple units of other types, or size, or which have a predetermined pattern.

2. Description of the Prior Art

The prior art includes masonry units in which blocks having different spacing of pairs of flanges are provided on their rear faces in order that, when the blocks are laid in overlapping courses, alternate flanges may be aligned. Examples are McPherson U.S. Pat. No. 2,047,882 and Banneyer U.S. Pat. No. 2,700,294.

Patents disclosing blocks having a pair of flanges, each spaced one-fourth of the distance from an end of the block in order that the flanges may be aligned when the blocks are overlapped one-half, are, for example, Schall U.S. Pat. No. 751,346, Atterbury U.S. Pat. No. 1,255,573, and Zottoli U.S. Pat. No. 1,526,730.

Patents disclosing blocks having a single stud member on the rear face and in which the alternate rows are laid with the blocks in opposite directions include Higgins U.S. Pat. No. 721,188, MacBeth U.S. Pat. No. 938,678 and Staman U.S. Pat. No. 2,008,775.

Patents disclosing block elements with projections having narrow neck portions are Rocic U.S. Pat. No. 1,571,645 and Isenhour U.S. Pat. No. 2,185,669.

Patents disclosing masonry units having the face formed to simulate multiple smaller units are Stout U.S. Pat. No. 1,571,815, O'Leary U.S. Pat. No. 2,199,112, Hartnell U.S. Pat. No. 3,824,755 and French Pat. No. 985,377 of 1951.

SUMMARY OF THE INVENTION

The present invention is embodied in a masonry block unit which has a pair of spaced vertical flanges on its inner face, the spacing of which, from the ends of the block and from each other, is related to the overlapping distance with which the block is to be laid. The units are aligned in the same direction for all courses and when laid certain of the flanges provide a vertical face in spaced relationship to the main block for supporting cladding, wallboards, panels and the like, and with predetermined spaces between the lines of flanges, the remaining flanges being easily removable. The configuration and arrangement of the units also permits the outer face of each unit to be formed to simulate multiple units, e.g. brick faces, in order that the laying of a wall of the units will simulate on the outer face a wall of the similar units.

It is an object of the invention to provide a masonry block unit having a pair of rearwardly extending, vertically disposed flanges in predetermined spaced relationship to one end of the block so that a plurality of courses of block may be laid in overlapping relationship with each other with certain of the flanges of one course being in vertical alignment with flanges of adjacent courses and with the non-aligned flanges being easily removable.

BRIEF DESCRIPTION OF THE DRAWINGS

FIG. 1 is a rear perspective view of a masonry block unit in accordance with the present invention.

FIG. 2 is a rear perspective view of a prior art masonry block unit.

FIG. 3 is a front elevational view of a preferred embodiment of the invention.

FIG. 4 is a top plan view of a unit in accordance with the invention.

FIG. 5 is a plan view similar to FIG. 4 with one of the flanges removed.

DESCRIPTION OF THE PREFERRED EMBODIMENTS

Figure 6:
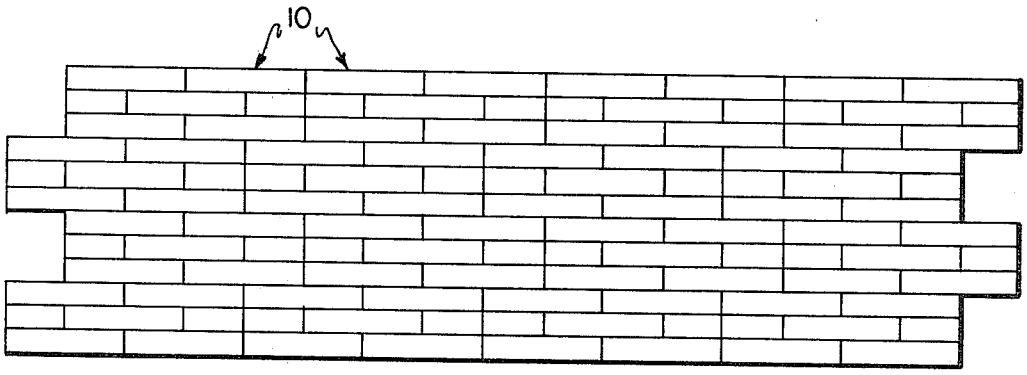
FIG. 6 is a front elevational view of a wall constructed of units in accordance with the present invention in which the outer faces are formed to simulate multiple units of brick.

With further reference to the drawing, a masonry block unit is illustrated in FIG. 1 which is generally of a known type, as illustrated, for example, in the patent to Amundson U.S. Pat. No. 2,852,933. The already known type of block has a main section 10 connected by spaced webs 11 and 12 to a wall member 13. The main section 10 has a front wall 15 and a rear wall 16 connected by end web portions 17 and 18 and a central web portion 19, the section having openings or cavities 20 and 21. Such known type unit does not include the flanges 30 and 32 which will be described later.

Blocks having the foregoing described elements are selected for numerous types of construction, especially those in which insulation is of significance.

A prior art block of generally similar type having a flange F on its rear face is illustrated in FIG. 2. A wall with a block of the type indicated in FIG. 2 has on its rear face the appearance illustrated in FIG. 8. It will be observed that the blocks in alternate courses are arranged with the flange located adjacent to opposite ends of the block. In other words, it is necessary for the workmen laying the wall to reverse the direction of the blocks for each succeeding course of the wall in order to have all of the flanges of the vertically positioned blocks line up, as illustrated in FIG. 8.

Figure 8:
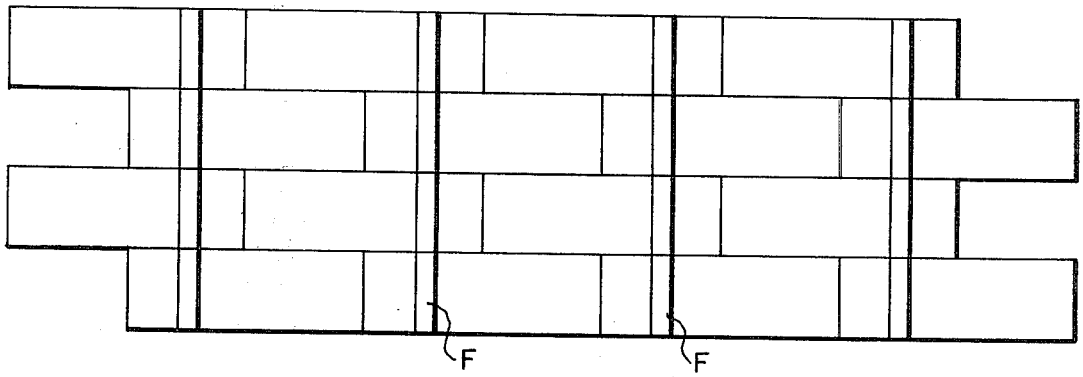
(PRIOR ART) FIG. 8
FIG. 8 is a rear elevational view of a wall constructed of block of the type illustrated in FIG. 2.

In addition, the wall of FIG. 8 requires that the blocks be overlapped a required distance. Such overlapping places a restriction on the use of blocks having faces formed too simulate multiple units.

The block in the present invention is particularly adapted for use in laying a wall whose outer face simulates a brick wall.

A conventional block may have its face formed to simulate three courses of brick, as illustrated in FIG. 3, in which the upper and lower courses represent two whole bricks, end to end, and the intermediate course simulates a whole brick intermediate two half bricks.

It will be apparent that in order to lay up block having a face as in FIG. 3, to simulate a brick wall, it is necessary that the succeeding courses of block overlap one-fourth the length of the block. In order that the one-fourth overlap may be employed and accomplish the purpose of providing a continuous aligned flange of the blocks that are in a vertical stack and in order that the blocks may be all used in the same direction, the present invention includes the provision of a first flange 30 whose center line is spaced from the end 18 of the block a distance A which may be one-fourth of the length of the block, and a second flange 32 whose center line is spaced from the center line of the flange 30 a distance A and spaced from the end 18 a distance B which may be one-half of the length of the block. Each of the flanges 30 and 32 is provided with a reduced neck defined by indentations, or lines of weakening 33 along its sides and adjacent to the rear face 13' of the wall 13 in order that a workman may easily remove the major portion of a selected flange, as indicated in FIG. 5 merely by tapping the side thereof.

Figure 7:
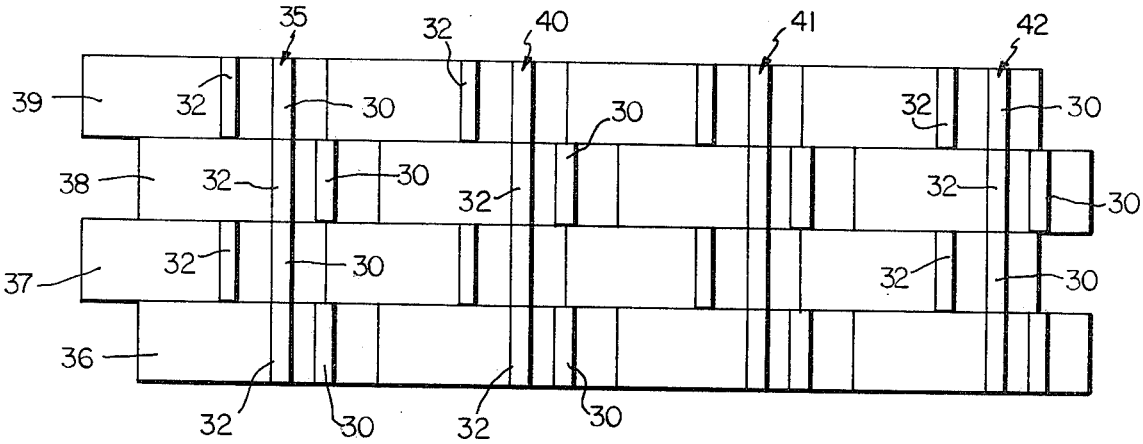
FIG. 7 is a rear elevational view of the wall of FIG. 6.

Thus, as illustrated in FIG. 7, the rear face of a wall which is laid in a plurality of vertically disposed courses 36, 37, 38 and 39, has a series of spaced vertically aligned flanges. Accordingly, a first line of flanges 35 is formed when the flange 32 of the masonry block units 10 of the lower course 36 are aligned with the flanges 30 of the next higher course 37. The flanges 30 of the course 37 are aligned with the flange 32 of the next higher course 38 which in turn is aligned with the flange 30 of the next higher course 39 and so on until the wall reaches a desired height. The non-aligned flanges 30, 32, 30, 32, respectively, of the courses 36–39 are removed. Following this plan for the entire length of the wall provides additional rear lines of aligned flanges 40, 41 and 42 which are spaced apart a predetermined distance. In practice, a spacing of approximately sixteen inches is a distance which is commonly employed as a stud spacing or support for cladding such as sheet rock, wooden wall paneling, and the like. Such spacing also provides ready accommodation for standard insulation batts of fourteen inch widths.

We claim:

1. In a masonry block for constructing a wall having a plurality of overlapping courses with the masonry blocks being arranged in the same direction and in which said masonry blocks have front faces which simulate cooperating multiple units and rear faces having generally vertically aligned flanges for supporting sheet material, the improvement comprising, a generally rectangular masonry block having front and rear faces and end walls, said front face of each block having designs and partial designs which cooperate with the designs of contiguous blocks to form an overall design on the wall, the design on each of said masonry blocks being arranged so that said masonry blocks of one course are overlapped a predetermined amount relative to the blocks of adjacent courses, said rear face of each masonry block having a pair of generally parallel vertically disposed flanges extending rearwardly therefrom, one of said flanges being spaced from one end of said masonry block a distance corresponding to the distance to be overlapped, the other of said flanges being spaced from said one flange a distance substantially equal to the distance to be overlapped, and each of said flanges being connected to said rear face by a reduced neck defining a weakened portion, whereby when a plurality of masonry blocks are arranged in overlapping courses said one flange of one masonry block is vertically aligned with said other flange of said masonry blocks of adjacent courses after which the non-aligned flanges are removed.

* * * * *